US005839941A

United States Patent [19]

Chen

[11] Patent Number: 5,839,941

[45] Date of Patent: Nov. 24, 1998

[54] TOY CAR WITH A SWINGING UNIT WHICH SWINGS WHILE THE CAR IS IN MOTION

[76] Inventor: Hwa-Lo Chen, 5F, No. 56, Chin-Chiang St., Chung-Cheng Dist., Taipei City, Taiwan

[21] Appl. No.: 918,489

[22] Filed: Aug. 26, 1997

[51] Int. Cl.[6] ..... A63H 17/40

[52] U.S. Cl. ..... 446/442; 446/462; 446/470

[58] Field of Search ..... 446/441, 442, 446/448, 462, 470

[56] References Cited

U.S. PATENT DOCUMENTS

| | | | |
|---|---|---|---|
| 2,770,074 | 11/1956 | Jones et al. | 446/442 |
| 3,386,406 | 6/1968 | Tsunoda | 446/442 |
| 3,965,612 | 6/1976 | Asano | 446/442 |
| 4,485,587 | 12/1984 | Barlow et al. | 446/442 |

*Primary Examiner*—Robert A. Hafer
*Assistant Examiner*—Jeffrey D. Carlson
*Attorney, Agent, or Firm*—Limbach & Limbach L.L.P.

[57] ABSTRACT

A toy car includes a chassis, a power supplying mechanism disposed on the chassis, a cover attached to and above the chassis, a swinging unit mounted swingably on the cover, a cam wheel disposed rotatably on the chassis, and a driving wheel unit. A transmission is disposed between the power supplying mechanism and the cam wheel and between the power supplying mechanism and the driving wheel unit so as to rotate the driving wheel unit and the cam wheel by actuation of the power supplying mechanism and so as to reverse the rotational direction of the driving wheel unit and the cam wheel upon collision of the car with a stationary object. A follower unit interconnects the swinging unit and the cam wheel so as to rotate the swinging unit between a first position and a second position relative to the cover upon rotation of the cam wheel on the chassis in a first direction. When the cam wheel rotates in a second direction which is opposite to the first direction, a pushing unit pushes the swinging unit to a third position relative to the cover.

4 Claims, 9 Drawing Sheets

TOY CAR WITH A SWINGING UNIT WHICH SWINGS WHILE THE CAR IS IN MOTION

BACKGROUND OF THE INVENTION

1. Field of the Invention

This invention relates to a toy car, more particularly to a toy car which has a swinging unit that swings while the toy car is in notion.

2. Description of the Related Art

A known toy car is designed so that the moving direction thereof can automatically change upon collision with a stationary or sufficiently heavy object. However, such a toy car still cannot satisfy children due to the continued development of differently designed toy cars.

SUMMARY OF THE INVENTION

The object of this invention is to provide a toy car which can move in the reverse direction upon collision with a stationary or sufficiently heavy object and which has a swinging unit that can swing while the toy car is in motion.

According to this invention, a toy car includes a chassis, a power supplying mechanism disposed on the chassis, a cover attached to a top surface of the chassis, a swinging unit mounted swingably on the cover, a cam wheel disposed rotatably on the chassis, and a driving wheel unit. A transmission is disposed between the power supplying mechanism and the cam wheel and between the power supplying mechanism and the driving wheel unit so as to rotate the driving wheel unit and the cam wheel by actuation of the power supplying mechanism and so as to reverse the rotational direction of the driving wheel unit and the cam wheel upon collision of the car with a stationary object. A follower unit interconnects the swinging unit and the cam wheel so as to rotate the swinging unit between a first position and a second position relative to the cover upon rotation of the cam wheel on the chassis in a first direction. When the cam wheel rotates in a second direction which is opposite to the first direction, a pushing unit pushes the swinging unit to a third position relative to the cover.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
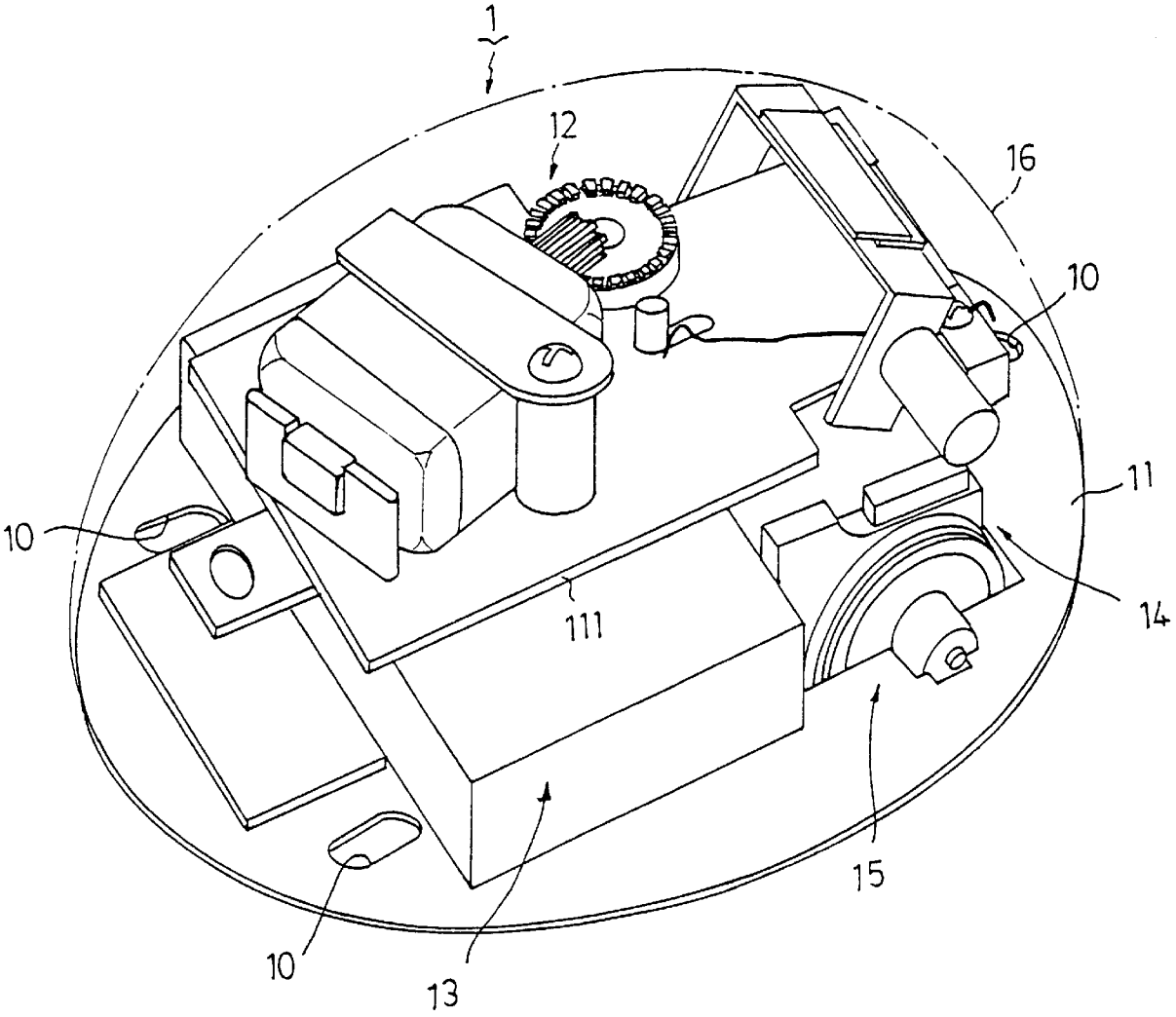
FIG. 1 is a perspective view showing a toy car of a preferred embodiment of this invention, wherein a cover and a swinging unit thereof are removed for clarity.

FIG. 1 shows a toy car 1 of a preferred embodiment of this invention which includes a chassis 11 that is provided with a base plate 111 and formed with three parallel slots 10, a power supplying mechanism 12, a transmission 13, a pushing unit 14, a wheel assembly 15 and a cover assembly 16.

Figure 2:
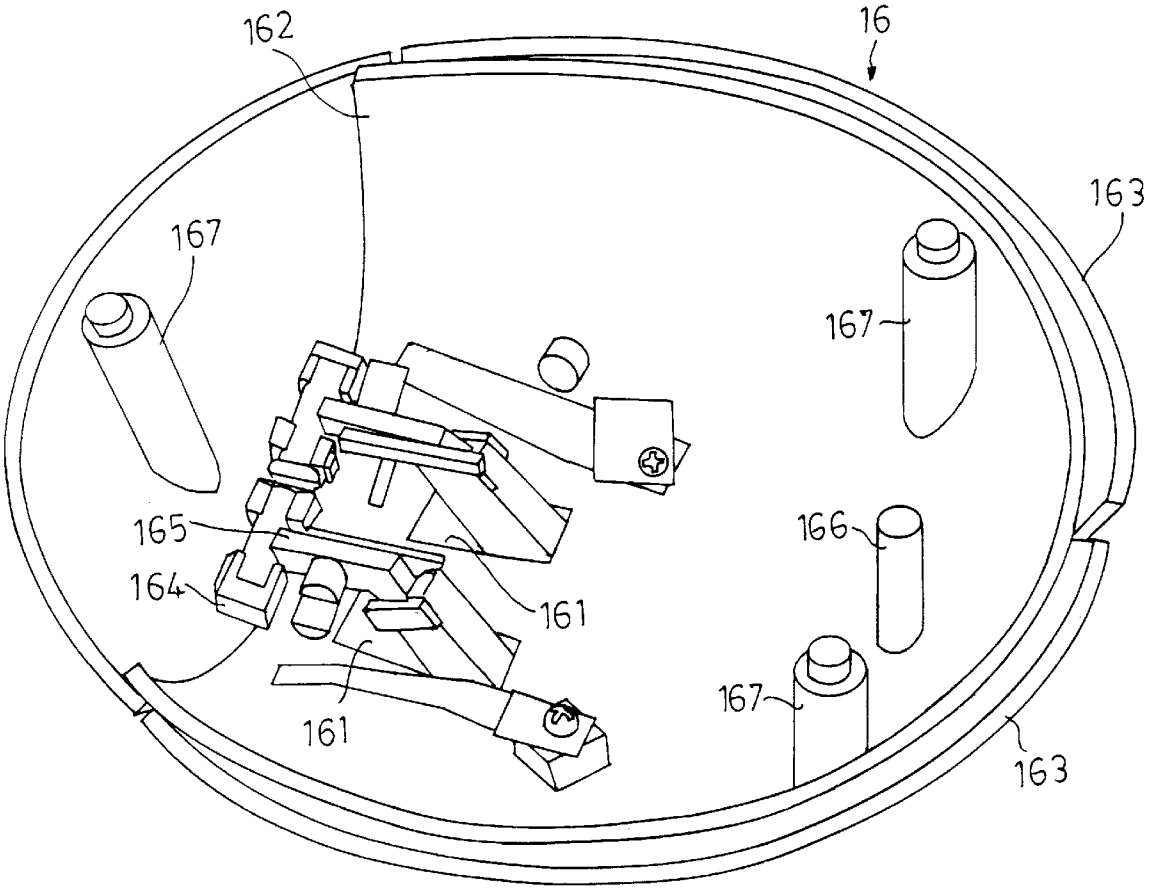
FIG. 2 is an inverted perspective view showing the cover and the swinging unit of the toy car according to the preferred embodiment of this invention.

As shown in FIG. 2, the cover mechanism 16 includes a cover 162 attached to a top surface of the chassis 11, and two swinging units 163. The cover 162 has two slots 161 and an outer periphery which is located outside the outer periphery of the chassis 11, and is provided with an adjacent pair of pivot seats 164 on which the lower ends of two swing rods 165 are respectively and pivotally mounted. The swing rods 165 respectively extend through the slots 161 of the cover 162 and have upper ends which are press fitted within two recesses 165' (see FIG. 7) in the swinging units 163, thereby permitting swinging movement of the swinging units 163 with the swing rods 165 on the cover 162. The cover 162 further has a fixed vertical connecting rod 166 and three fixed vertical guide rods 167 which are respectively and slidably retained within the slide slots 10 in the chassis 11, thereby permitting forward and rearward movement of the cover 162 on the chassis 11.

Figure 3:
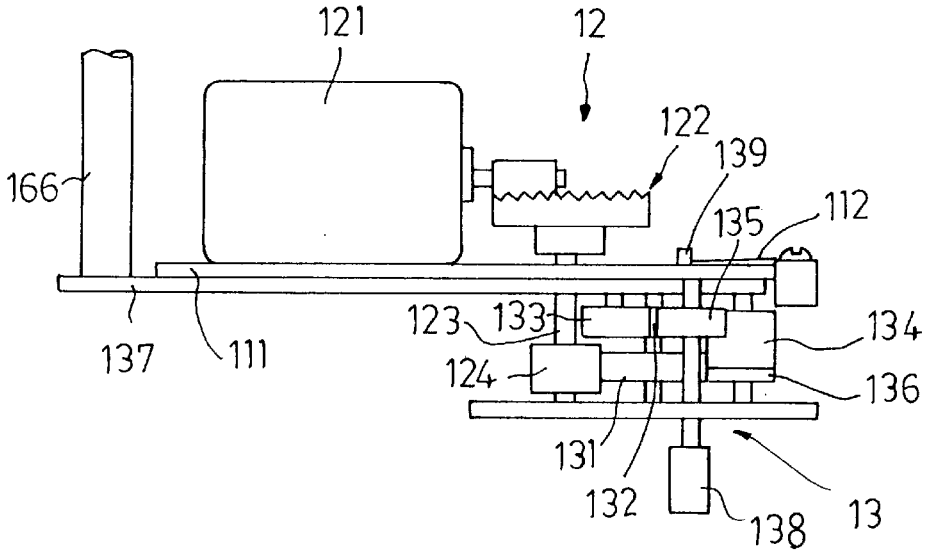
FIG. 3 is a side view showing a transmission of the toy car of the preferred embodiment of this invention.
Figure 4:
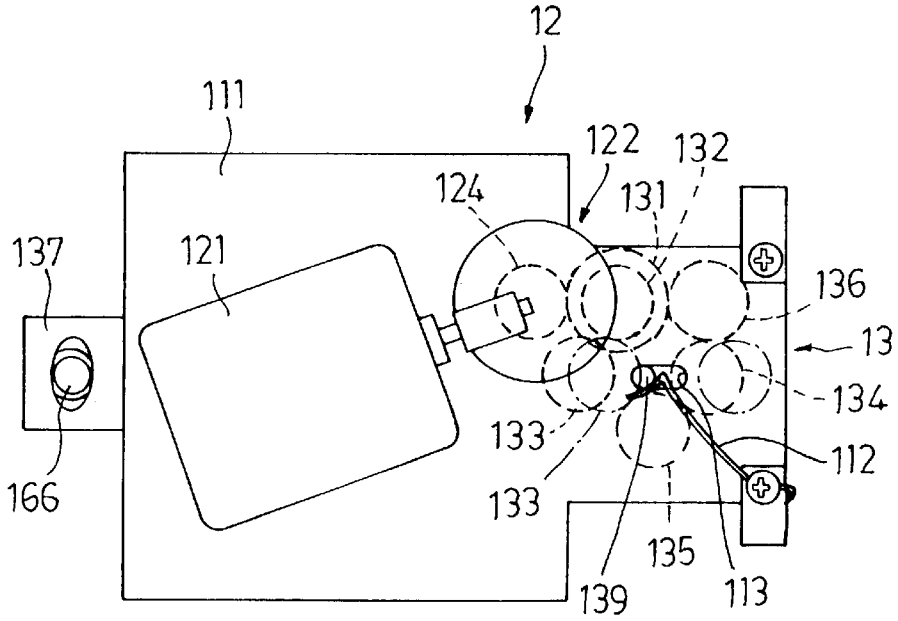
FIG. 4 is a top view showing the transmission of the toy car of the preferred embodiment of this invention.

Referring to FIGS. 3 and 4, the power supplying mechanism 12 includes a motor 121, a speed reduction device 122 and an output shaft 123 which is provided with a fixed gear 124 and which can rotate when the motor 121 is powered. The transmission 13 includes a drive gear 131 meshing with the gear 124 of the power supplying mechanism 12, a first driving gear 132 fixed coaxially to the drive gear 131, a first intermediate gear 133, a second intermediate gear 134, a driven gear 135, a second driving gear 136, a movable plate 137 fixed to the connecting rod 166 of the cover 162 (see FIG. 2) and to the first and second intermediate gears 133, 134, a pinion 138 (see FIGS. 5 and 5A) fixed coaxially to the driven gear 135, and a guide rod 139 which is fixed to the movable plate 137 and which is received slidably within a slide slot 113 in the base plate 111 of the chassis 11 (see FIG. 1). A generally L-shaped spring plate or spring unit 112 is fixed to the base plate 111 at an end thereof so as to urge the guide rod 139 to either of the front and rear ends of slide slot 113.

As illustrated in FIG. 4, when the guide rod 139 is located at the left end of the slide slot 113, the first intermediate gear 133 is moved to a left position indicated by the dotted lines in which the first intermediate gear 133 is removed from the first driving gear 132 and the driven gear 135, while the second intermediate gear 134 is moved to a left position indicated by the dotted lines in which the second intermediate gear 134 meshes with the second driving gear 136 and the driven gear 135. When the guide rod 139 is located at the right end of the slide slot 113, the first intermediate gear 133 is moved to a right position indicated by the phantom lines in which the first intermediate gear 133 meshes with the first driving gear 132 and the driven gear 135, while the second intermediate gear 134 is moved to a right position indicated by the phantom lines in which the second intermediate gear 134 is removed from the second driving gear 136 and the driven gear 135.

Figure 5:
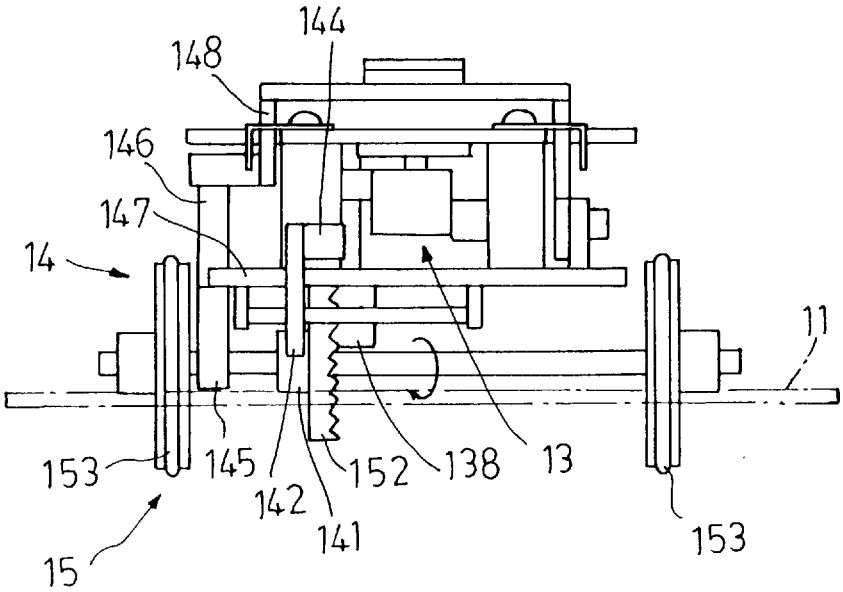
FIG. 5 illustrates how two front wheels of the toy car of the preferred embodiment of this invention are driven.
Figure 5A:
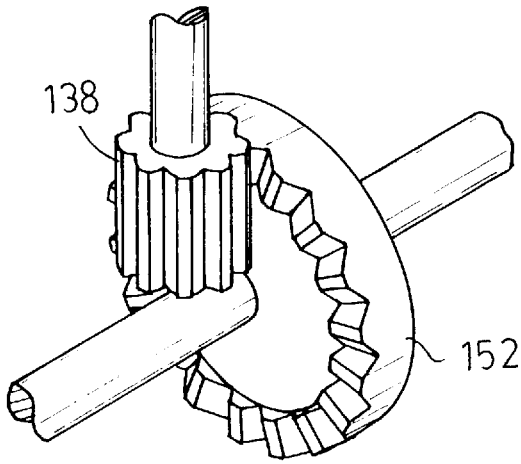
FIG. 5A illustrates how a crown gear is driven by a pinion in the toy car of the preferred embodiment of this invention.
Figure 6:
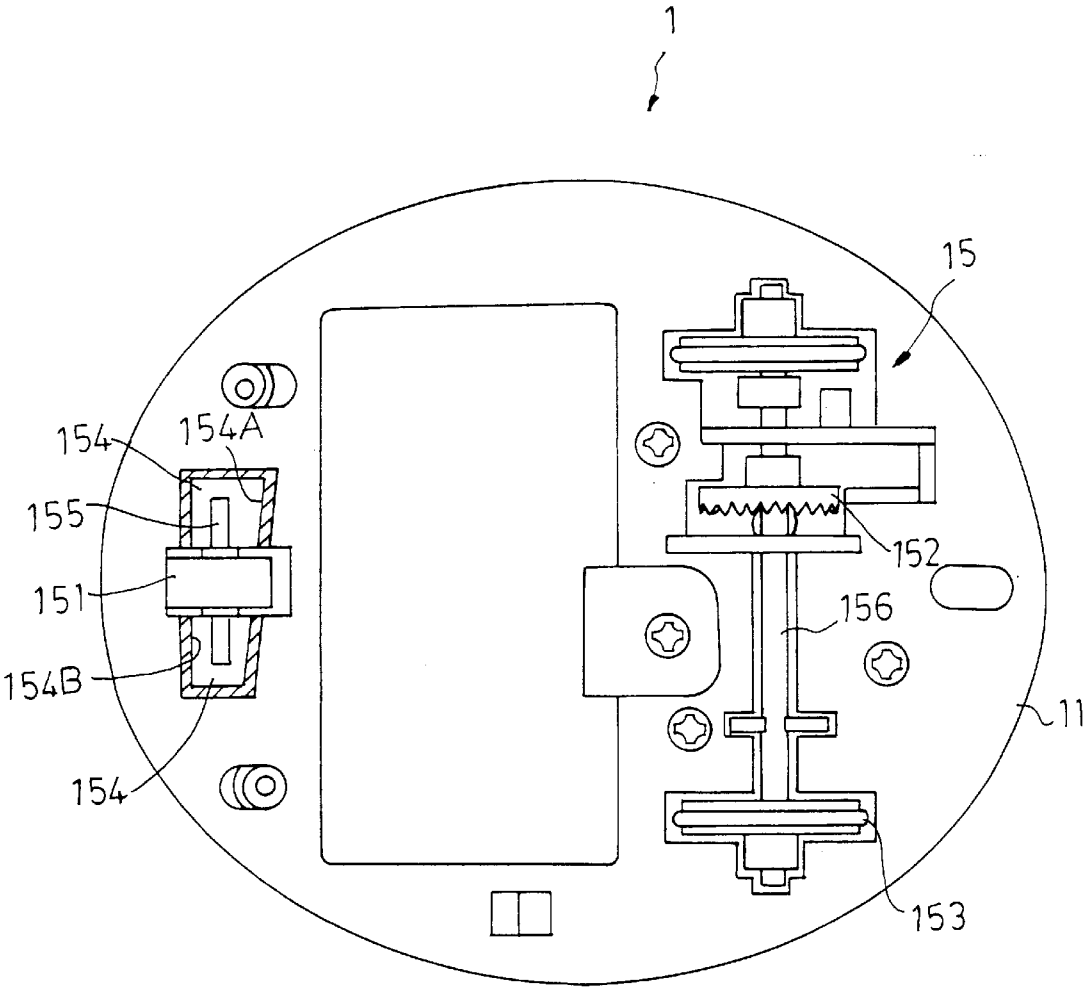
FIG. 6 illustrates how a free rear wheel is disposed on a chassis of the toy car of the preferred embodiment of this invention.
Figure 7:
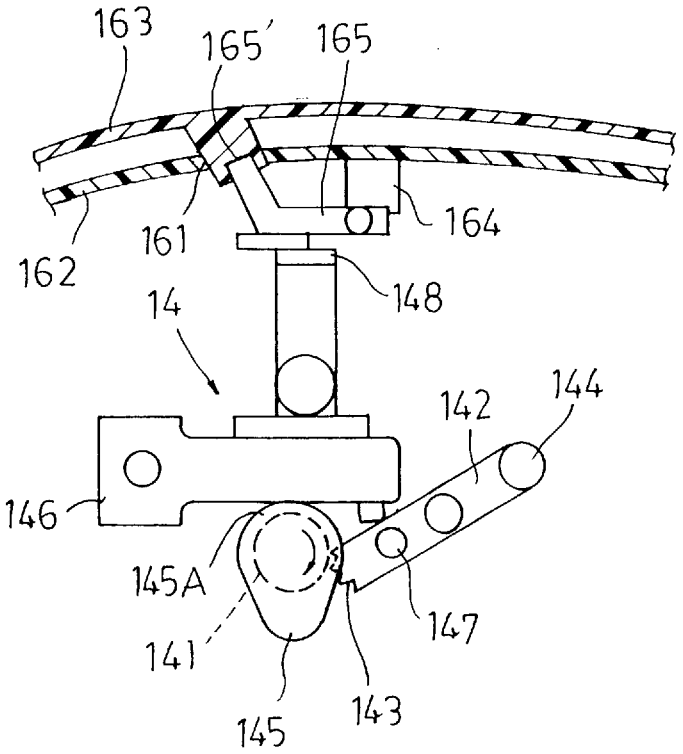
FIG. 7 illustrates a first position of the swinging unit of the toy car of the preferred embodiment of this invention.

Referring to FIGS. 5, 6 and 7, the wheel assembly 15 includes a free rear wheel 151 rotatable freely on the chassis 1, a crown gear 152 (see FIGS. 5 and 5A) meshing with the pinion 138 (see FIGS. 5 and 5A), a driving wheel unit disposed in front of the free rear wheel 151 and consisting of two front wheels 153, two bearing holes 154 formed in the chassis 11, a rear axle 155 journalled within the bearing holes 154, and a front axle 156 on which the crown gear 152 and the front wheels 153 are fixed. The bearing holes 15.4 have two aligned straight front sides 154A inclined relative to the front axle 156, and two aligned straight rear sides 154B parallel to the front axle 156.

When the toy car 1 (see FIG. 1) moves forward, the rear axle 155 engages the rear sides 154B of the bearing holes 154, thereby moving the car (see FIG. 1) along, a straight path. When the toy car 1 moves rearward, the rear axle 155 engages the front sides 154A of the bearing holes 154, thereby moving the toy car 1 along a curved path.

The pushing unit 14 includes a crank engaging gear 141 fixed coaxially to the crown gear 152, and a crank 142 which has an intermediate portion pivoted to the chassis 11, a first end portion formed with a toothed end surface 143 and a second end portion equipped with a counterweight 144 which biases the first end portion of the crank 142 to abut against a lower portion of the crank engaging gear 141 when a cam wheel 145 fixed coaxially to the crank engaging gear 141 rotates in a first or clockwise direction indicated by the arrowhead in FIG. 7.

Figure 8:
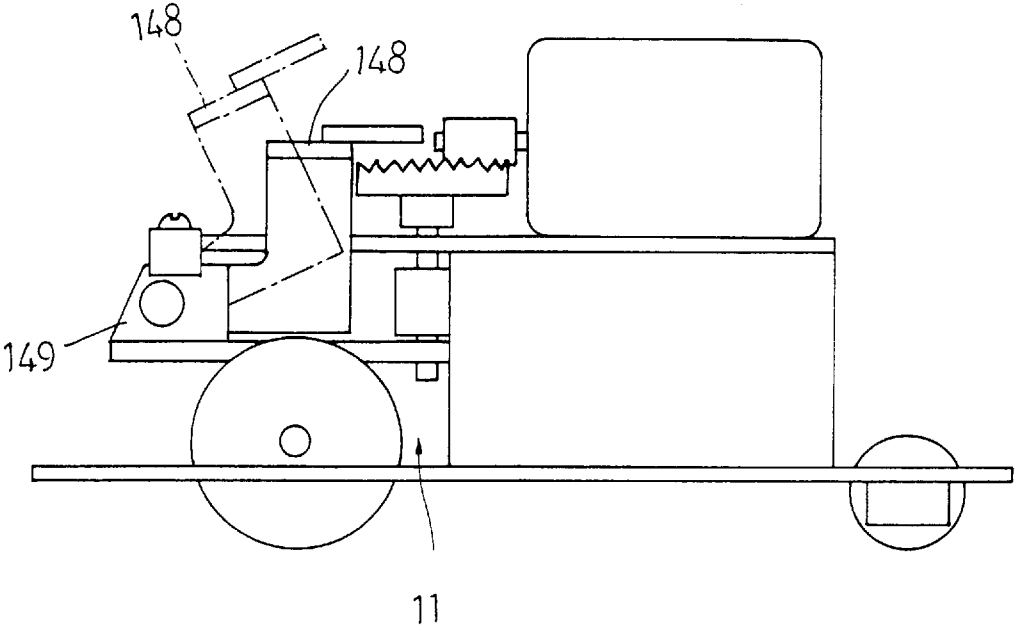
FIG. 8 illustrates how a push plate of a follower unit of the toy car of the preferred embodiment of this invention is operated.

A follower unit includes a swing arm 146 which is pivoted to the chassis 11 and which engages the cam wheel 145 by virtue of gravity. When the cam wheel 145 rotates, the swing arm 146 swing to turn an inverted U-shaped push plate 148 (see FIG. 5) which is pivoted to a side plate 149 (see FIG. 8) of the chassis 11 (see FIG. 8) and which engages the swing rods 165 so that each of the swinging units 163 (see FIG. 2) rotates synchronously with the corresponding swing rod 165 between a first position shown in FIG. 7 in which a non-lobe portion 145A engages the swing arm 146, and a second position shown in FIG. 9 in which a lobe portion 145B engages the swing arm 146.

Figure 9:
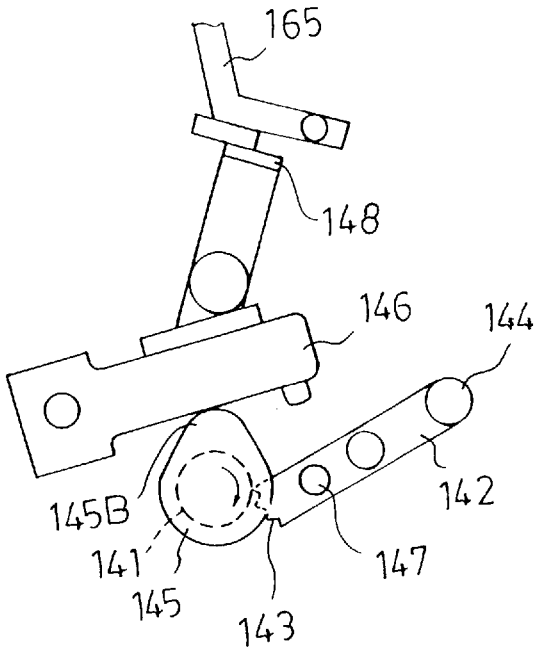
FIG. 9 illustrates a second position of the swinging unit of the toy car of the preferred embodiment of this invention.
Figure 10:
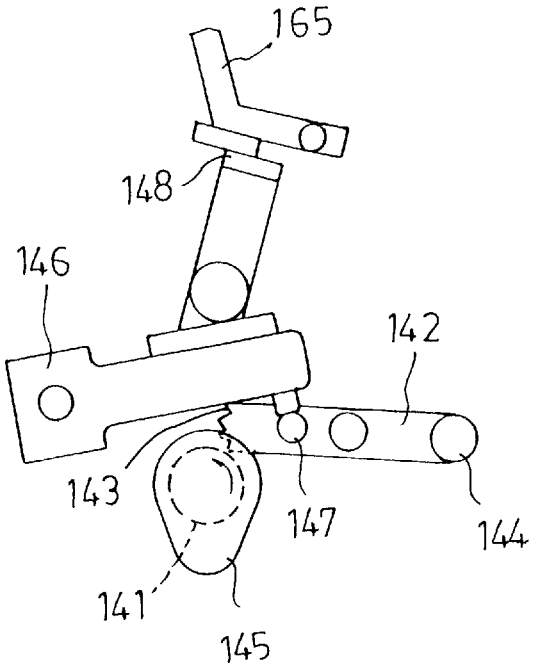
FIG. 10 illustrates how the swinging unit of the toy car of the preferred embodiment of this invention is moved to a third position.

The crank 142 further has a fixed horizontal push rod 147 which can rotate about the pivoted point of the crank 142 between an upper position shown in FIG. 10 and a lower position shown in FIGS. 7 and 9. In a situation where the push rod 147 is located at the upper position shown in FIG. 10, when the cam wheel 145 rotates in the first or clockwise direction, the toothed end surface 143 of the crank 142 rotates in a second or counterclockwise direction to mesh with the crank engaging gear 141 until the push rod 147 turns to the lower position shown in FIG. 7, in which the swing arm 146 falls to rest on the non-lobe portion 145A of the cam wheel 145. Then, when the cam wheel 145 rotates in the second or counterclockwise direction, the tooth end surface 143 of the crank 142 rotates in the first or clockwise direction to once again mesh with the crank engaging gear 141 until the push rod 147 turns to the upper position shown in FIG. 10, in which the push rod 147 turns the swing arm 146 upward so that the push plate 148 rotates clockwise, thereby rotating the swinging units 163 (see FIG. 2) with the swing rods 165 to a third position.

Figure 11:
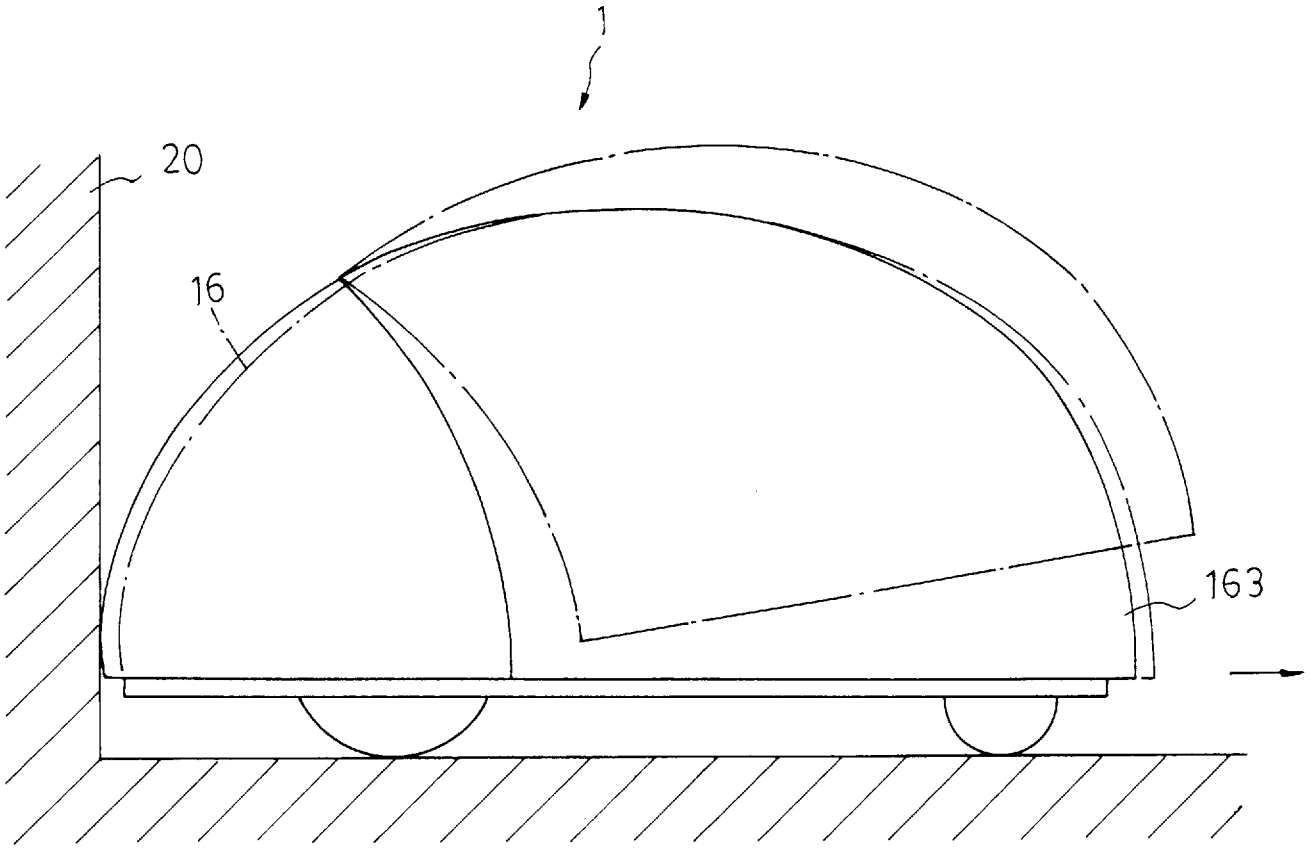
FIG. 11 illustrates how the swinging unit of the toy car of the preferred embodiment of this invention is swung.

Accordingly, as shown in FIG. 11, when the toy car 1 moves forward along a straight path, the swinging units 163 swing between the position indicated by the solid lines and that by the phantom lines in a manner simulating the wings of an insect. When the toy car 1 collides with a stationary or sufficiently heavy object, such as a vertical wall 20, it moves in the reverse direction along a curved path.

With this invention thus explained, it is apparent that numerous modifications and variations can be made without departing from the scope and spirit of this invention. It is therefore intended that this invention be limited only as indicated in the appended claims.

I claim:

1. A toy car comprising:

a chassis:

a power supplying mechanism disposed on said chassis;

a cover attached to a top surface of said chassis;

a swinging unit mounted swingably on said cover;

a cam wheel disposed rotatably on said chassis;

a driving wheel unit disposed rotatably on said chassis;

a transmission disposed between said power supplying mechanism and said cam wheel and between said power supplying mechanism and said driving wheel unit so as to rotate said driving wheel unit and said cam wheel by actuation of said power supplying mechanism and so as to reverse rotational direction of said driving wheel unit and said cam wheel upon collision of said car with a stationary object;

a follower unit interconnecting said swinging unit and said cam wheel so as to rotate said swinging unit between a first position and a second position relative to said cover upon rotation of said cam wheel on said chassis in a first direction; and a pushing unit for positioning said swinging unit at a third position relative to said cover upon rotation of said cam wheel on said chassis in a second direction which is opposite to said first direction.

2. A toy car as claimed in claim 1, wherein said follower unit includes a swing arm which is pivoted to said chassis and which is swung by said cam wheel to swing said swinging unit, said pushing unit including:

a crank having an intermediate portion pivoted to said chassis, a first end portion formed with a toothed end surface and a fixed horizontal push rod which is rotatable between an upper position and a lower position, and a second end portion equipped with a counterweight ; and a crank engaging gear fixed coaxially to said cam wheel, said counterweight biasing said push rod of said crank to press against a lower portion of said crank engaging gear when said cam wheel rotates on said chassis in the first direction, said toothed surface of said crank rotating on said chassis and meshing with said crank engaging gear when said push rod of said crank rotates from said upper position to said lower position in said second direction and from said lower position to said upper position in said first direction, said first end portion of said crank resting on an upper portion of said crank engaging gear when said push rod is located at said upper position while said cam wheel rotates in the second direction so that said push rod of said crank pushes upward said follower unit, thereby turning said swinging unit to the third position.

3. A toy car as claimed in claim 1, wherein said chassis is formed with a plurality of parallel slide slots, each of which has a front end and a rear end, said cover including an outer periphery which is located outside an outer periphery of said chassis, and a plurality of fixed guide rods which are slidable forward and rearward in said slide slots respectively, thereby permitting forward and rearward movement of said cover on said chassis when said outer periphery of said cover collides with the stationary object, said power supplying mechanism including an output shaft which is journalled on said chassis and which rotates when said power supply mechanism is powered, said driving wheel unit including two front wheels and a front axle on which said front wheels are sleeved fixedly and coaxially, said car further including a free rear wheel which is mounted rotatably on said chassis behind said driving wheel unit and which rotates freely on said chassis, and a spring unit which urges said guide rod to either of said front and rear ends of said slide slot, said transmission including:

a first driving gear drivable by said output shaft;

a second driving gear rotating with said first driving gear in such a manner that said first and second driving gears rotate in opposite directions;

driven gear coupled with said front axle so that rotation of said driven gear is transmitted to said front axle;

a first intermediate gear secured to said cover; and a second intermediate gear secured to said cover and positioned relative to said first intermediate gear in such a manner that one of said first and second intermediate gears meshes simultaneously with said driven gear and one of said first and second driving gears when said guide rod is located at one of said front and rear ends of said slide slot, while the other one of said first and second intermediate gears meshes simultaneously with said driven gear and the other one of said first and second driving gears when said guide rod is located at the other one of said front and rear ends of said slide slot, collision of said car with the stationary object moving said cover on said chassis so as to reverse rotational direction of said driven gear and said front wheels, thereby reversing moving direction of said car.

4. A toy car as claimed in claim 3, wherein said free rear wheel has a fixed rear axle, said chassis being formed with two bearing holes which have aligned straight rear sides parallel to said front axle, and aligned straight front sides inclined relative to said front axle, forward movement of said car resulting in engagement of said rear axle with said rear sides of said bearing holes, thereby moving said car along a straight path, rearward movement of said car resulting in engagement of said rear axle with said front sides of said bearing holes, thereby moving said car along a curved path.

* * * * *